US008419421B2

(12) United States Patent
Hirota et al.

(10) Patent No.: US 8,419,421 B2
(45) Date of Patent: Apr. 16, 2013

(54) INJECTION FLAME BURNER AND FURNACE EQUIPPED WITH SAME BURNER AND METHOD FOR GENERATING FLAME

(75) Inventors: Osamu Hirota, Kyoto (JP); Yoshinari Kato, Mizunami (JP); Toshihiko Ando, Tokyo (JP)

(73) Assignee: Osamu Hirota, Kyoto-Shi (JP)

( * ) Notice: Subject to any disclaimer, the term of this patent is extended or adjusted under 35 U.S.C. 154(b) by 711 days.

(21) Appl. No.: 12/086,498

(22) PCT Filed: Dec. 13, 2006

(86) PCT No.: PCT/JP2006/325312

§ 371 (c)(1),
(2), (4) Date: Mar. 4, 2010

(87) PCT Pub. No.: WO2007/069772

PCT Pub. Date: Jun. 21, 2007

(65) Prior Publication Data

US 2010/0154789 A1 Jun. 24, 2010

(30) Foreign Application Priority Data

Dec. 14, 2005 (JP) ..... 2005-360473

(51) Int. Cl.
*F23C 7/00* (2006.01)

(52) U.S. Cl.
USPC ..... 431/187; 431/8

(58) Field of Classification Search ..... 431/8, 187
See application file for complete search history.

(56) References Cited

U.S. PATENT DOCUMENTS 328,914 A * 10/1885 Ashcroft ..... 431/179
1,729,677 A * 10/1929 Miller ..... 239/430
2,095,065 A * 10/1937 Hays ..... 431/7
2,360,548 A * 10/1944 Conway ..... 431/8
2,506,853 A * 5/1950 Berg et al. ..... 166/59
2,541,347 A * 2/1951 Eckstein et al. ..... 239/402.5
3,224,679 A * 12/1965 Kear et al. ..... 239/132.3
3,490,870 A * 1/1970 De Land ..... 423/455
3,529,915 A * 9/1970 Sakai et al. ..... 431/284
3,615,213 A * 10/1971 Shepherd ..... 423/450
4,475,885 A * 10/1984 Finke ..... 431/182

(Continued)

FOREIGN PATENT DOCUMENTS

JP A 07-277745 10/1995
JP A 10-294303 11/1998

(Continued)

*Primary Examiner* — Kenneth Rinehart
*Assistant Examiner* — Jorge Pereiro
(74) *Attorney, Agent, or Firm* — Oliff & Berridge, PLC

(57) ABSTRACT

An injection flame burner in which temperature of the generated flame itself can be sustained around the flame. A plurality of double structure injection nozzles each consisting of an outer tube and an inner tube provided coaxially with the outer tube, are arranged such that hydrogen gas is ejected from one of the outer tubes and the inner tubes and oxygen gas is ejected from the other tubes, and the injection port of each injection nozzle is located on the injection surface. Each injection nozzle includes at least one main injection nozzle having an inner tube formed to spread toward the injection surface side, and another sub-injection nozzle arranged around the main injection nozzle, wherein gas is injected from the inner tube of the main injection nozzle under a higher pressure state as compared with gas injected from the sub-injection nozzle.

3 Claims, 9 Drawing Sheets

U.S. PATENT DOCUMENTS

| | | | | |
|---|---|---|---|---|
| 4,525,138 | A * | 6/1985 | Snyder et al. | 431/187 |
| 4,702,691 | A * | 10/1987 | Ogden | 431/187 |
| 5,110,285 | A * | 5/1992 | Snyder et al. | 431/8 |
| 5,112,219 | A * | 5/1992 | Hiemstra | 431/354 |
| 5,135,730 | A * | 8/1992 | Suzuki et al. | 423/446 |
| 5,209,656 | A * | 5/1993 | Kobayashi et al. | 431/187 |
| 5,284,438 | A * | 2/1994 | McGill et al. | 431/9 |
| 5,295,816 | A * | 3/1994 | Kobayashi et al. | 431/9 |
| 5,403,181 | A * | 4/1995 | Tanaka et al. | 431/8 |
| 5,441,403 | A * | 8/1995 | Tanaka et al. | 431/175 |
| 5,732,893 | A * | 3/1998 | Nied | 241/39 |
| 5,803,725 | A * | 9/1998 | Horn et al. | 431/187 |
| 6,038,861 | A * | 3/2000 | Amos et al. | 60/737 |
| 6,062,848 | A * | 5/2000 | Lifshits | 431/285 |
| 6,152,051 | A * | 11/2000 | Kiyama et al. | 110/262 |
| 6,241,510 | B1 * | 6/2001 | Anderson et al. | 431/8 |
| 6,250,915 | B1 * | 6/2001 | Satchell et al. | 432/19 |
| 6,254,379 | B1 * | 7/2001 | Bool et al. | 431/4 |
| 6,383,445 | B1 * | 5/2002 | Anderson et al. | 266/225 |
| 6,474,982 | B2 * | 11/2002 | Satchell et al. | 432/19 |
| 6,638,057 | B2 * | 10/2003 | Watson et al. | 431/174 |
| 6,962,055 | B2 * | 11/2005 | Chen et al. | 60/746 |
| 7,107,772 | B2 * | 9/2006 | Chen et al. | 60/737 |
| 7,509,811 | B2 * | 3/2009 | Chen et al. | 60/776 |
| 2003/0108834 | A1 * | 6/2003 | Pelton | 431/8 |
| 2004/0060301 | A1 * | 4/2004 | Chen et al. | 60/776 |
| 2004/0187526 | A1 * | 9/2004 | Shirota et al. | 65/531 |
| 2005/0126180 | A1 * | 6/2005 | Chen et al. | 60/776 |
| 2005/0129603 | A1 * | 6/2005 | Szillat et al. | 423/335 |
| 2006/0147853 | A1 * | 7/2006 | Lipp et al. | 431/8 |
| 2007/0033948 | A1 * | 2/2007 | Chen et al. | 60/776 |

FOREIGN PATENT DOCUMENTS

| | | |
|---|---|---|
| JP | A 10-294308 | 11/1998 |
| JP | A 2000-039128 | 2/2000 |
| JP | A 2000-039138 | 2/2000 |
| JP | A 2002-267108 | 9/2002 |
| JP | A 2003-130315 | 5/2003 |
| JP | A 2003-518603 | 6/2003 |
| JP | A 2005-089267 | 4/2005 |
| WO | WO 01/48422 A1 | 7/2001 |
| WO | WO 01/48423 A1 | 7/2001 |

* cited by examiner

INJECTION FLAME BURNER AND FURNACE EQUIPPED WITH SAME BURNER AND METHOD FOR GENERATING FLAME

RELATED TECHNICAL FIELD

This invention relates to an injection flame burner that uses ejected hydrogen gas and oxygen gas thereof, a furnace equipped with said burner, and also a method for generating a flame.

BACKGROUND OF THE INVENTION

Japanese Patent Laid Open No. 2000-39138 discloses a method of burning out waste by hydrogen gas and by oxygen gas. For example, obtained Brown's Gas that is mixed by hydrogen gas and oxygen gas at a capacity rate 2:1, is ejected from a nozzle, and is provided with a flame having a temperature of over 2,500 degrees C., wherein the generated flame of the obtained Brown's Gas at a high temperature is furnished to burn waste. As a result, poisonous substances produced by heavy metals and the like, is confined into remnants in the form of glass fiber, including ashes produced by strong burning, whereas the proper treatment apparatus for the poisonous substance is provided. In this type of treatment, the mixed gas as explained above produces the burning flame at a temperature that is between 2,000 degrees C. and 2,500 degrees C.

Apart from said device, Japanese Patent Laid Open No. 2003-130315 provides another burner apparatus, where a far lower temperature rise of between 1,000 degrees C. and 1,500 degrees C. is adopted thereof.

Another burner apparatus is also disclosed by Japanese Patent Laid Open No. Hei-10-294303. The apparatus is built with the following features: a tubular oxygen gas supplying nozzle that is prepared while a hydrogen supplying gas is formed on the center of the oxygen gas supplying nozzle, and around a port of the hydrogen gas at a top point location over the port, the oxygen gas ejecting port for the oxygen supplying nozzle is prepared. A flame is ejected with a thick and short shape in the vicinity of the oxygen gas supplying port, so that the tip of the flame does not contact the wall of the burning tube so as to prevent the burning tube from losing transparency and melting.

However, in these prior apparatuses, the burning temperature for the waste cannot clear remnants of glass fiber, and at the same time, the burning temperature suddenly becomes lower when the waste separates from the burning flame, and thus the waste remains in either a melting state or in a solid state. The flame of prior apparatuses is ejected in a thick and short condition, which results in the burned remnants being in the solid state.

The present invention, therefore, aims to develop an injecting flame burner that generates a flame to burn waste completely, without any remnant, and also aims to develop a furnace equipped with said burner for complete combustion of the waste.

The present invention includes a plurality of double structure injection nozzles, each consisting of an outer tube and an inner tube that are provided coaxially with each other and are arranged wherein hydrogen gas is ejected from one tube while oxygen gas is ejected from the other tube, and at least one of the inner tubes in a main nozzle is formed such that it spreads toward an outside position, while a sub-nozzle is prepared adjacently, and a generated flame is ejected by burning the gas of the sub-nozzle that is collided with the ejected gas of the main nozzle, which results in a flaring of the flame. Thus, the temperature of the generated flame itself can be maintained thereabout, and the obtained flame can dismiss at least 99% of the generated waste. This dismissal also eliminates the generation of dioxin.

SUMMARY OF THE INVENTION

In one example of the present invention, an injection flame burner which comprises: a inner tube formed coaxially to an outer tube; hydrogen gas is ejected from one side of the outer tube and the inner tube, while oxygen gas is ejected from other side of the tubes where a plurality of double structure injection nozzles are arranged while each injection nozzle port is seated on the relative injecting surface; each injection nozzle is formed to be spread toward the injecting surface, wherein the spread shape is formed with a flared shape; and at least one main ejecting nozzle is set while the other sub-ejecting nozzle is prepared around the main ejecting nozzle.

The injection flame burner that has gas ejected from the inner tube of the main injection nozzle that is at a higher pressure than the gas ejected from the sub-nozzle.

The ejected ports of the injection flame burner are located in various portions and the ejected port of the main injection nozzle is located on the center position for the sub-nozzle.

A furnace is equipped with a burning room wall that is covered with a fireproof material so that the wall is durable against the high temperatures of the flame which is caused by the hydrogen gas and oxygen gas ejected from the injection flame burner.

Hydrogen gas is ejected from one of the outer and inner tubes that are formed coaxially with each other while oxygen gas is ejected from the other tube, wherein a plurality of the double structure injection nozzles is aligned in a concentric circle, and the gas ejected from the inner tube of the main nozzle formed on the center portion is ejected with a higher speed than the gas that is ejected from the sub nozzle that is adjoined to the main nozzle, and then the generated flame caused by the burning of ejected gas from the main nozzle is collided with the generated flame caused by the burning of ejected gas from the sub nozzle, and thus the shape of the flame is devised to be widened in a flaring condition.

According to the present invention, the flame is generated in an enlarged condition after the burning of the gas that is ejected from the main nozzle, and then against this obtained flame, the other flame generated by the gas burning from the sub nozzle is directed to be collided in the flaring condition. Thus, the high temperatures that are generated around flame can be maintained, and at least 99% of the waste can be eliminated by the obtained flame, so that dioxin generation can be prevented. Therefore, the developed invention can be utilized to completely incinerate the dangerous or poisonous substances in the burning site of a local public entity or in that of hospitals.

DESCRIPTIONS OF THE PREFERRED EMBODIMENTS

Figure 1:
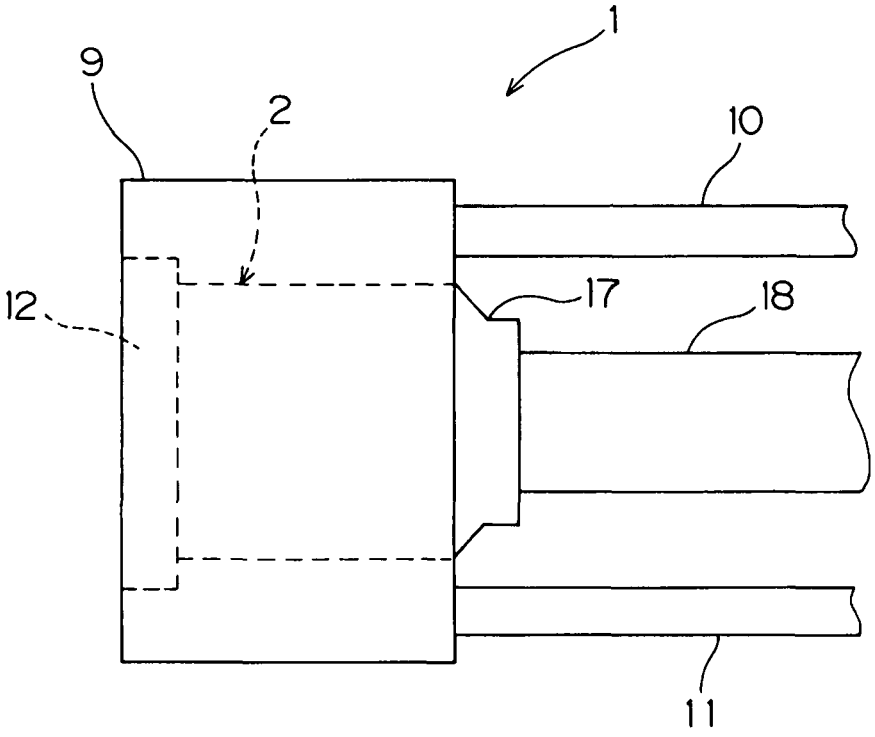
FIG. 1 is a side view of an injection flame burner.
Figure 2:
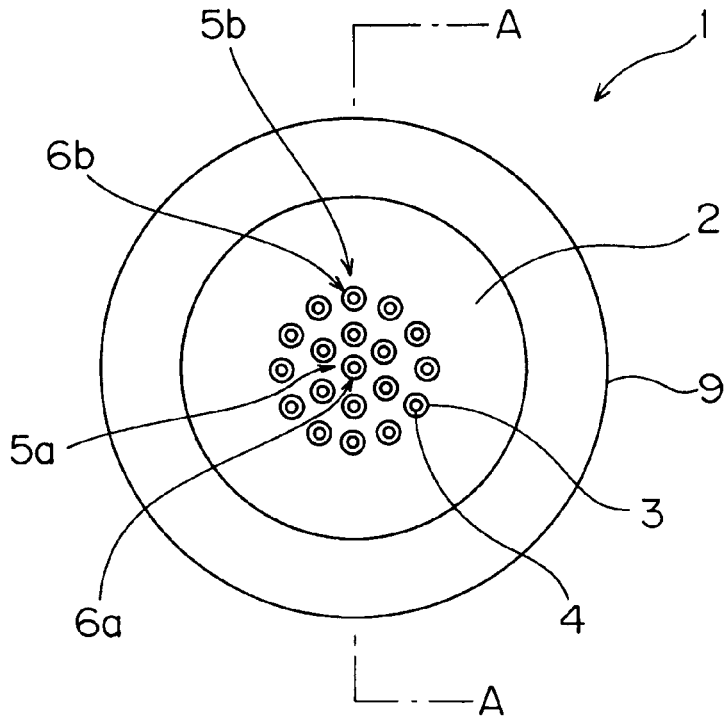
FIG. 2 is a front view of the injection flame burner as shown in FIG. 1.
Figure 3:
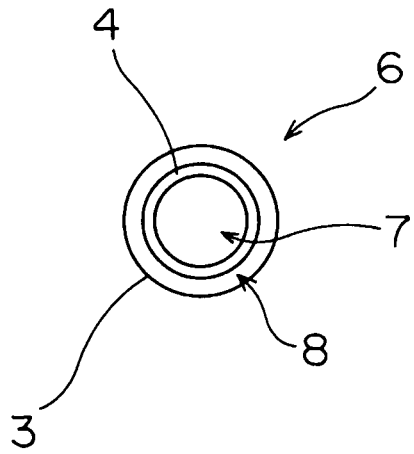
FIG. 3 is a front view of an injection port as shown in FIG. 2.
Figure 4:
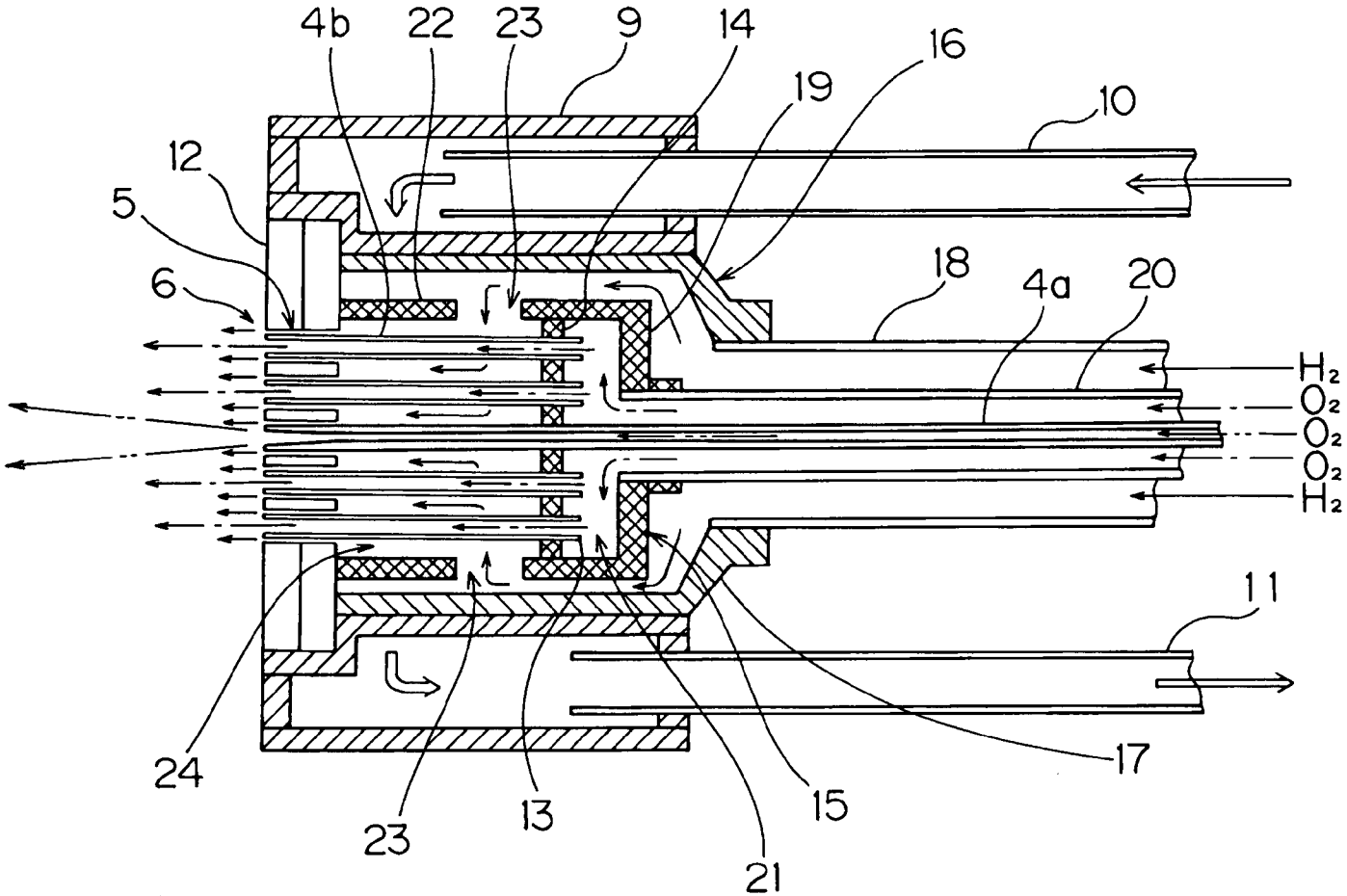
FIG. 4 is a sectional plan view of the injection flame burner along the line A-A as shown in FIG. 2.
Figure 5:
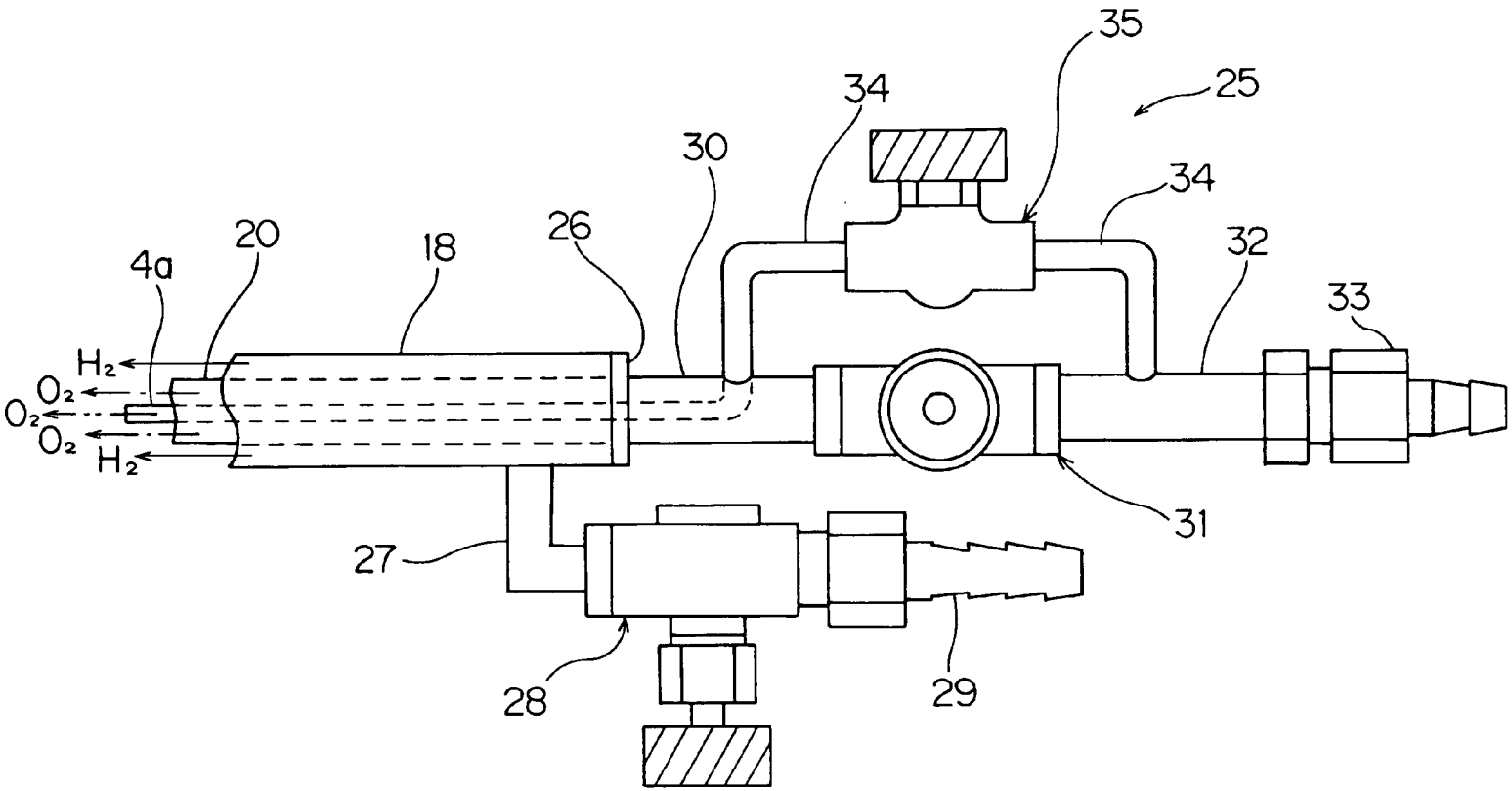
FIG. 5 is a side view of a gas supply portion of the injection burner as shown in FIG. 1.
Figure 6:
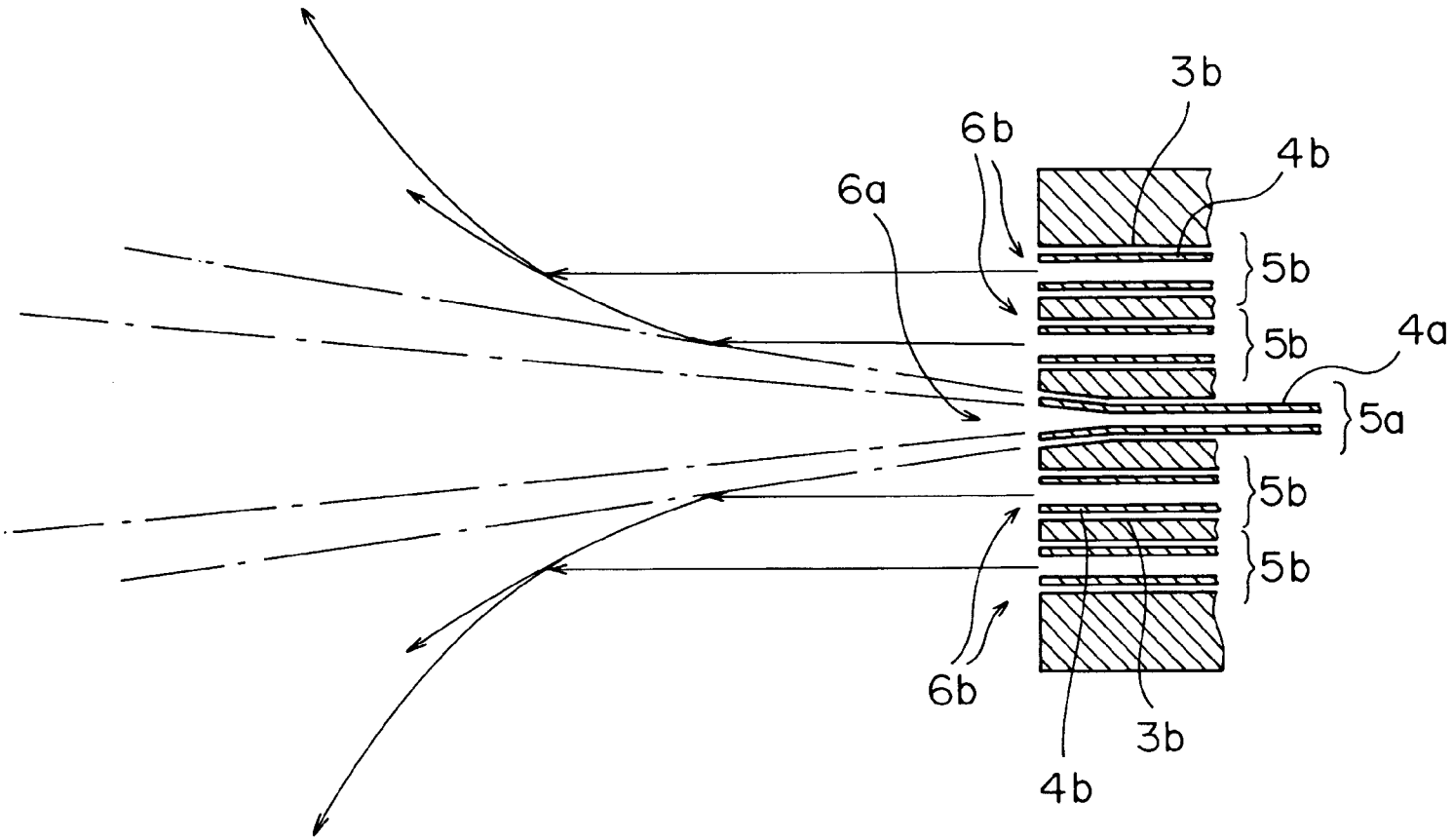
FIG. 6 is an illustration of flame shape ejecting from the injection burner.

FIG. 1 shows a side view of an injection flame burner while a gas supply portion which supplies hydrogen gas and oxygen gas is omitted. FIG. 2 is a front view of the injection flame burner shown in FIG. 1, while FIG. 3 is a front view of an injection port as shown in FIG. 2. FIG. 4 is a sectional plan view of the injection flame burner along the line A-A as shown in FIG. 2, and FIG. 5 is a side view of a gas supply portion of the injection burner as shown in FIG. 1. FIG. 6 is an illustration of a flame that is ejected from the injection burner. In these figures, reference numeral "1" indicates the injection flame burner, and reference numeral "2" indicates a top portion with a column shape for the injection flame burner (1), and on the surface of this top portion (2), namely an injecting surface, both an outer tube (3) that injects hydrogen gas and an inner tube (4) formed coaxially with the outer tube (3) that injects oxygen gas, are prepared in a plurality of double structures, wherein plural injecting ports (6) of a cylindrical injecting nozzle (5) are located separately. The injecting port (6) comprises a round oxygen gas injection port (7) and a circular hydrogen gas injection port (8). Reference numeral "9" is a hollow and cylindrical refrigerator formed in contact with the outer circumference of the top portion (2). On the rear surface of the refrigerator (9), a supply tube (10) is connected to supply a refrigerating liquid, while in contrast with the connected place of the supply tube (10), an ejecting tube (11) is connected in order to eject the refrigerating liquid, the liquid is supplied from the tube (10) to refrigerate the top portion (2) and then the liquid is devised to be ejected out through the refrigerator (9) via an ejecting tube (11).

As shown in FIG. 6, the injecting nozzle (5) has a main injection nozzle (5*a*) equipped with a inner tube (4*a*) formed in with a cone shaped head extending toward the surface, and it also has the another sub injection nozzle (5*b*) equipped with a inner tube (4*b*) and located around the main injection nozzle (5*a*). The center for a injection port (6*a*) of the main injection nozzle (5*a*) is located as if it envelopes a injecting port (6*b*) of the sub injection nozzle (5*b*) in a concentric circle, as shown in FIG. 2.

As shown in FIG. 4, the top portion with a column shape (2) is prepared with a disk-like surface lid (12) where the injection port (6) is formed, is prepared with the injection nozzle (5) aligned in a rectangular position with said lid (12), is formed in contact with the back side of the lid (12), is prepared with a cylindrical gas supply room (15) having a shut-up plate (14) while a rear end port (13) of the inner tube (4*b*) for the sub injection nozzle (5*b*) including the injection nozzle (5) remains, is formed in contact with the back side of the lid (15), and is prepared with a cylindrical hydrogen gas supply room (16) which supplies hydrogen gas into the outer tube (3), including a cylindrical gas supply room (15) with a gap. In the hydrogen gas supply room (16), a hole is drilled in a ceiling of the room (19) in order to connect with a oxygen gas supply tube (20) via a hydrogen gas supply tube (18). Further, the inner tube (4*a*) of the main injection nozzle (5) is prepared through the oxygen tube (20) and penetrates the shut-up plate (14). An oxygen gas filled room (21) is established in the cylindrical gas supply room (15), that includes the ceiling of gas supply room (19) and the shut-up plate (14), while the rear-end port (13) of the inner tube (4*b*) extends therefrom. A hydrogen gas filled room (24) is also established against a cylindrical wall (22) that is equipped with a hydrogen gas passage (23) in the gas supply room (15) between the lid (12) and the shut-up plate (14).

The three inner tubes (4*a*) (or an extending tube formed for this inner tube) of the main injection nozzle (5), the oxygen gas supply tube (20), and the hydrogen gas supply tube (18), are extended and connected with the gas supply portion (25) of the injection flame burner (1). As shown in FIG. 5, the hydrogen gas supply pipe (18) is formed as a cylinder and a starting end portion (26) of the gas supply pipe (18) which is closed in a lid form is connected in the vicinity of a side wall of a starting end portion (26) with a L-letter Pipe (27). Through the L-letter pipe (27), an adjusting valve for hydrogen gas (28) is connected by a screwable connection and also a bamboo joint pipe for hydrogen gas (29) is connected with the adjusting valve (28). The oxygen gas supply tube (20) is formed with a cylindrical shape, and extends and penetrates the starting end portion (26), and the tube (20) has a screwable adjusting valve for oxygen gas (31) via a forward extending tube (30). A bamboo joint pipe for oxygen gas (33) is also connected with the adjusting valve (31) via a rear extending tube (32). The inner tube (4*a*) of the main nozzle (5*a*) is extended to a forward extending tube (30) and is drilled in the side to run through a by-pass tube (34) having an screwable adjusting jet valve (35), and the tube (4*a*) is connected with a rear extending tube (32). With the piping facility, a tube supplying hydrogen gas is connected with the bamboo joint pipe (29) of the gas supply portion (25), while the tube supplying oxygen gas is also connected with the bamboo joint pipe for oxygen gas (33).

An ignition method is explained as follows.

First, each adjusting valve for reference numerals "28," "31" and"35" is prepared in a closed condition, and the tube for supplying hydrogen gas is connected with the bamboo joint pipe for hydrogen gas (29), while on the other hand the tube for supplying oxygen gas is connected with the bamboo joint pipe for oxygen gas (33), and a cooling liquid, for example, is supplied with the refrigerator (9) via the supply tube (10) so that the cooling liquid may circulate in the refrigerator (9). Then, the adjusting valve for hydrogen gas (28) is opened. Hydrogen gas comes through the L-letter pipe (27) into the hydrogen gas supply tube (18). As shown in FIG. 4, Hydrogen gas runs through the gas supply room (16) and its passage (23) arrives at the gas filled room (24) where the gas is filled in high pressure, the gas then runs through the outer tube (3) and is then finally is ejected out from the injection port (8) of the injection nozzle (5), and thus the injected hydrogen gas is ignited. In the same way as shown in FIG. 4, the adjusting valve for oxygen gas (31) is opened. Oxygen gas comes into the tube (20) via the forward extending tube (30), and the gas is invited into the filled room (21) of the gas supply room (15), and then the gas filled in the room at high pressure comes through the inner tube (4*b*) from the rear end port (13) and finally the gas is ejected out from the injecting port (7*b*) for igniting. Further, when the adjusting jet valve (35) is opened, oxygen gas in the rear extending tube (32) that runs through the by-pass tube (34) via the inner tube (4*a*) is finally ejected from the injection port (7*a*) of the main nozzle (5*a*). In this case, the opening and closing of the adjusting jet valve shall be handled so that oxygen gas injected from the inner tube (4*a*) of the main nozzle (5*a*) may be at a higher speed than that injected from the sub injection nozzle (5*b*).

Concerning the burning ratio between hydrogen gas and oxygen gas, it is preferable that the ratio is hydrogen gas 1.1 against oxygen gas 1.0 because this ratio attains the near perfect burning. This burning ratio shall be adjusted in accordance with the decided pressure, and it is preferable to decide injection pressure for both hydrogen gas and oxygen gas to be between 0.3 MPa and 0.5 MPa. An injection pressure below 0.3 MPa causes incomplete combustion, while a pressure over 0.5 MPa invites the combustion power in vain. The injection pressure of oxygen gas to be injected by the inner tube (4*a*) of the main nozzle (5*a*) shall be preferably between 0.3 MPa and 0.5 Mpa, at 0.2 MPa higher than said decided pressure. For examples, when the injection pressure of hydrogen gas is decided at 0.44 MPa after adjusting the valve (28), and the injection pressure of oxygen gas is decided at 0.40 MPa after adjusting the valve (31), the injection pressure of oxygen gas shall be set to 0.60 MPa after adjusting the jet valve (35).

For its extinguishing, first the jet valve (35) is closed, and secondly the valve (31) for oxygen gas is closed, and finally the valve (28) for hydrogen gas is closed.

Now, the flame shape to be injected from the injection burner (1) is now explained.

As shown in FIG. 6, gas burning from the main injection nozzle (5*a*) that is injected by the burner (1) generates a flame that extends straight forward. At the top end of this generated flame, gas burning from the sub injection nozzle (5*b*) bumps together, and thus the flame of the main nozzle is widened with a flared condition. Then, the high temperatures of the flame itself surrounding the flaring flame can be maintained. Further, where oxygen gas is injected from the inner tube (4*a*) of the main injection nozzle (5*a*) with a higher pressure than that injected from the sub injection nozzle (5*b*), the strength of the flame is much more increased. At the same time, the flame of the burning gas generated by the sub injection nozzle (5*b*) collides with the flame caused by the main injection nozzle (5*a*) at the top portion, and this collision produces a flaring flame, whereas higher temperatures can be maintained.

In the present embodiment, the injection flame burner (1), the disk-like surface lid (12), the injection nozzle (5), the cylinder gas supply room (15), the cylinder hydrogen gas supply room (18), the oxygen gas supply room (20), and the cylindrical refrigerator (9) may be produced with a stainless steel material. The injection nozzle (5) is produced by the disk of the stainless steel material with a circle hole drilled therein, and the stainless steel pipe is smaller than the circle hole that it is stably formed. The top portion (2) of the burner (1) and the injection nozzle may be supplied with a multilateral shape, rather than the circle shape. Moreover, hydrogen gas can be injected from the inner tube (4) while oxygen gas can be injected from the outer tube (5), but in this case, in the hydrogen gas is first injected for ignition and then secondly oxygen gas is injected therein, and then for extinguishments, oxygen gas supply is ceased first and then hydrogen gas stoppage follows.

By the present embodiment, the injection flame burner (1) produces the flaring flame at a temperature between 2,100 degrees C. and 2,300 degrees C., and the burning of the flame can be attained at between 2,500 and 2,600 degrees C. Thus, the obtained flaring flame and surrounding atmosphere can maintain the high temperatures of the flame itself and the maintained flame can incinerate at least 99% of the waste and eliminate the remnant substance about 99%, which can restrain the generation of poisonous dioxin.

1. First Example of Transformed Embodiment

Figure 7:
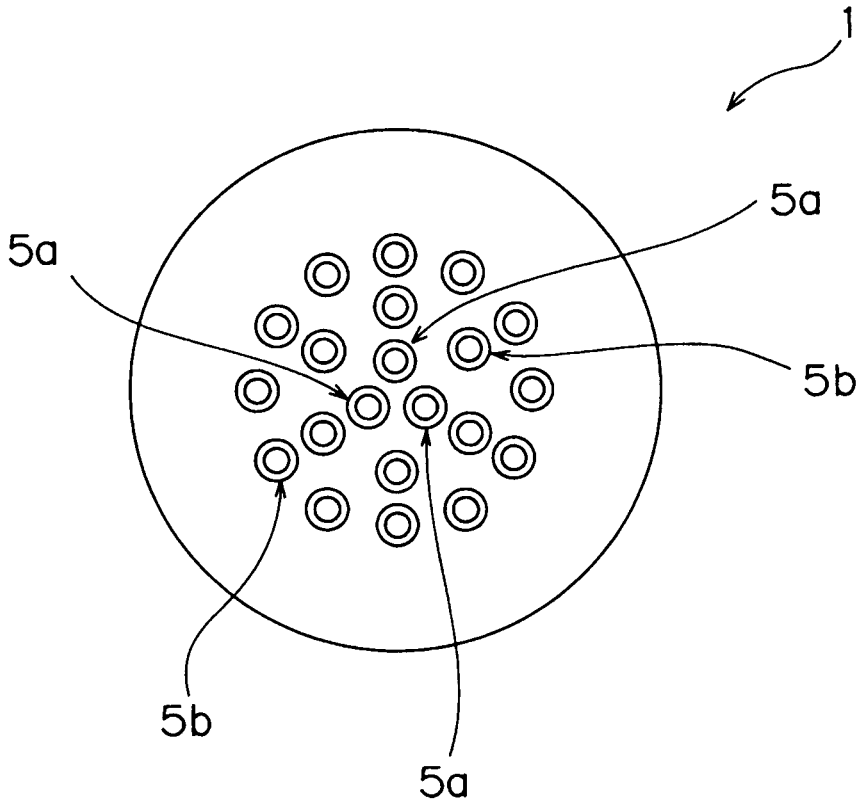
FIG. 7 is a front view of the injection flame burner.
Figure 8:
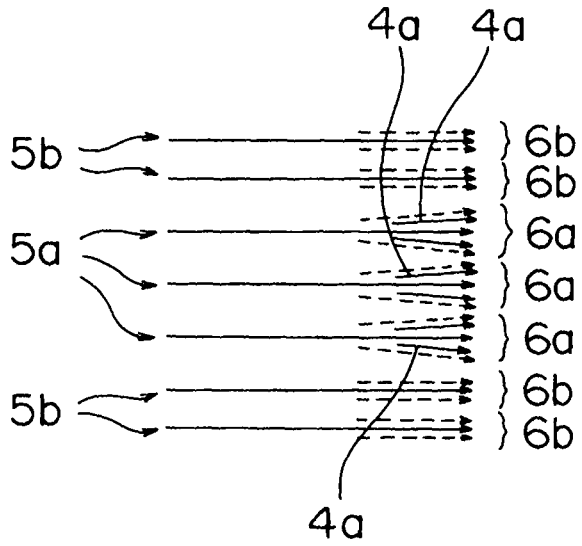
FIG. 8 is an illustration of ejecting gas.

This example is a transformed embodiment of the injection nozzle (5), and it is explained according to FIG. 1-FIG. 6. FIG. 7 is a plan view of the injection flame burner while the refrigerator is omitted. FIG. 8 is an illustration of gas being ejected wherein each reference numeral corresponds to that shown in FIG. 1-FIG. 6.

In the injection nozzle (5) three pieces of the main nozzles (5*a*) are formed at the center, and at the same time the plural sub nozzles in double lines surrounding the main nozzles (5*a*) in the concentric circle.

The injection flame burner (1) includes the outer tube (3) and the inner tube (4) is formed coaxially with the outer tube (3), and a plurality of double structure injection nozzles (5) that include the outer tube (3) that injects hydrogen gas and the inner tube (4) that injects oxygen gas is established while the injection port (6) is located on the disk-like surface lid (12). The three main nozzles (5*a*) equipped with the inner tube (4*a*) are prepared with a wide form against the lid (12), while a plurality of the sub nozzles (5*b*) are also prepared around the main nozzles (5*a*). Oxygen gas that is issued from the inner tube (4*a*) of the main nozzle (5*a*) is ejected with a higher pressure than that ejected from the sub nozzle (5*b*), and each injecting port (6*b*) of the semi-nozzle (5*b*) is located in separate positions, while each injecting port (6*a*) of the main nozzle (5*a*) is placed in the center position against each injecting port (6*b*) of the sub nozzle (5*b*).

When hydrogen gas is injected from the outer tube (3), oxygen gas is injected from the inner tube (4) in the double structure of the injecting nozzle (5). Three main nozzles (5*a*) are located in the center of the concentric arrangement, and the inner tube (4*a*) is formed in extending toward the outside. As oxygen gas issued from the inner tube (4*a*) of the main nozzle (5*a*) is ejected with a higher speed than that ejected from the sub nozzle (5*b*) that is adjoined to the main nozzle (5*a*), the flame generated by gas burning ejected by the main nozzle (5*a*) collides with another flame generated by gas burning ejected by the sub nozzle (5*b*), which causes the flame shape to flare in a high temperature condition.

2. Another Example of Transformed Embodiment

Figure 9:
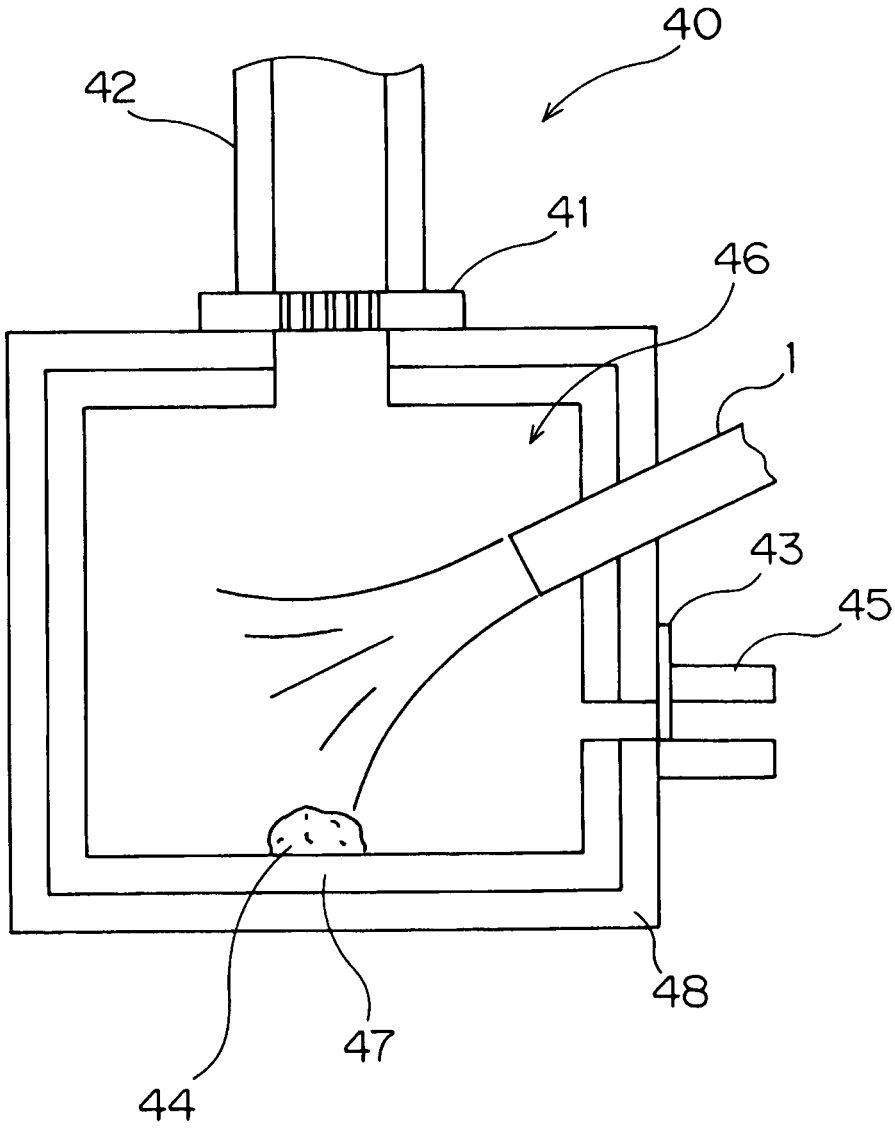
FIG. 9 is a sectional plan view of a furnace equipped with the injection flame burner.

FIG. 9 is a sectional plan view of a furnace equipped with an injection flame burner according to an example of the present invention. The reference numerals are identical with those that are referenced in FIG. 1 to FIG. 8. The reference numeral "40" is the furnace equipped with the injection flame burner (1), and the furnace (40) includes a chimney (42) formed with a ceramic filter (40), an inletting mouth for the waste (45) formed with an opening and shutting door (43) on its side, and a burning room (46) incinerating waste (44). In the inner wall of the burning room (46), a fireproof material (47) is covered thereon, and the cover is durable with high temperatures, for example, temperatures of 2,300 degrees C.-2,600 degrees C., wherein the temperature is caused by the flaring flame generated by the injection flame burner (1). The outer wall is protected with a heatproof material (47).

The fireproof material is produced in the method where a bone material including at least zirconia, calcium, magnesia and silica is sintered with mortar material to be a brick or tile. An example of the obtained material is disclosed in Japanese Patent Laid Open No. 2005-89267 as one of fireproof materials. Through the use of the fireproof material, even if the generated flame caused by the injection flame burner (1) reaches directly on the inner surface of the burning room (46), the fireproof quality can be maintained and therefore the inner atmosphere of the burning room (46) is kept as it is with the high temperatures that may be in the range of 2,300-2,600 degrees C., and thus over 99% of the waste (44) is eliminated and the generation of dioxin is prevented.

In this furnace (40), a plurality of the injection flame burners (1) can be equipped therein.

Now, the actual embodiment for the furnace (40) shall be explained in accordance with FIG. 1-FIG. 9 as below.

The injection flame burner may be formed with a stainless steel called SUS304.

The disk-like surface lid (12) may be established with a thickness of 9 mm and a diameter of 65 mm, and in the middle, a hole with a diameter of 4 mm may be drilled. As a center of this hole, 6 diameter holes at 4 mm diameter are drilled at a distance of 60 degree along an inside circumference of a concentric circle with a 15 mm diameter. In addition 12 holes with a 4 mm diameter are drilled at a distance of 30 degrees along an inside circumference of a concentric circle with a 25 mm diameter. The formed hole comprises the outer tube (3), into which the stainless pipe as the inner tube (4) with a diameter of 1.5 mm and length of 35 mm is inserted as the injection nozzle (5). Then, the cylindrical gas supply room (15) with a 41 mm outer diameter, a 37 mm inner diameter and a 35 mm height, is positioned onto the lid (12), the cylindrical hydrogen gas supply room (16) with a 50 mm outer diameter, a 45 mm inner diameter and a 42 mm height, is covered with said room (15). Then the oxygen gas supply tube (20) with a 12 mm outer diameter and a 6 mm inner diameter is connected to the room (14), while the hydrogen gas supply tube (18) with a 30 mm outer diameter and a 24 mm inner diameter is connected to the hydrogen gas room (18), wherein the tube (18) extends an extra 450 mm, and thus the gas supply room (25) is established.

Further, a conical reamer is used in the central inner tube (4) for widening the diameter to 2 mm, which produces the oxygen gas injection port (7*a*) of the inner tube (4*a*). The tube (4*a*) is extended by the stainless pipe to the gas supply room (25). In the hydrogen gas passage, 12 holes at a 5 mm diameter are drilled at the same pitch, and the rear end port (13) projects 3 mm from the shut-up plate (14). The top portion that is column-shaped (2), that is composed of the lid (12), the gas supply room (15) and the hydrogen gas supply room (16), is set on the stainless refrigerator (9) with a 50 mm inner diameter, a 105 mm outer diameter and a 49 mm height. The inside size of the refrigerator (9) is composed with a round shape with a 75 mm inner diameter and a 85 mm outer diameter and is connected to the supply tube (10) and the ejection tube (11), both of which have a 8 mm inner diameter.

Next, the fireproof material (47) is obtained in the method as disclosed in Japanese Patent Laid Open No. 2005-89267, namely the material that is produced is a bone material that includes at least zirconia, calcium, magnesia and silica, is sintered with mortar material to be a brick or a tile at the temperature of 1,850 degrees C. When an acetylene injection flame is radiated on the fireproof material for one hour and a half at a temperature of over 2,600 degrees C. the material (47) does not collapse and only exhibits a red burnt condition.

The burning room (46) is provided with a 690 mm length, a 690 mm width and a 1134 mm height, with a 47 mm thickness of the material (47) while the outside is covered with a heatproof material (48) of the same material (47) that is obtained, and thus the furnace (40) is provided with the injection flame burner (1). At the same time, a propane burner is also equipped with the furnace (40).

A 5 gram specimen for the temperature measurement is thrown into an inletting mouth (45), and the specimen includes the following: a test piece for 1,800 degrees C. (purity at 98% for alumina 100% included), a test piece for 1,950 degrees C. (purity at 99% for alumina 100% included), a test piece for 2,050 degrees C. (purity at 99.99% for alumina 100% included), a test piece for 2,100 degrees C. (purity at 99.99% for carbonate silicon included 100%), a test piece for 2,150 degrees C. (purity at 99.99% for carbonate silicon included 100% included), and a test piece for 2,200 degrees C. (purity at 99.999% for carbonate silicon 100% included). At the same time, 50 grams of waste, a scrapped material of vinyl chloride, is also dropped together.

The temperature in the burning room (46) is now elevated to 1,650 degrees C. by the propane burner. Then, cool water at the speed of 3 liter per hour is supplied in the supply tube (10). As shown in FIG. 5, hydrogen gas at 0.44 MPa is supplied from the bamboo joint pipe (29), and oxygen gas at 0.40 MPa is supplied from the other bamboo joint pipe (33) and then hydrogen gas at 0.60 MPa is also supplied through the by-pass tube (34), whereon the injection flame burner generates the flaring flame.

After the lapse of 5 hours, the temperature in the burning room (46) is elevated to the temperature of 2,600 degrees C., and thus all test pieces and the waste (44) are incinerated, and nearly no remnant is found thereafter.

The remaining gas in the chimney (43) is adopted as a sample, and the gas is measured in accordance with the JISK 1311 Test Method, as to whether poisonous dioxin or the similar substance exists therein. The result of the measurement shows 0.0000580 ng-TEQ/$m^3$·N.

The special Law in Japan for limiting dioxin or the similar decides the value as follows: average value per year 0.6 pg-TEQ/$m^3$ or below, in case of new facilities of the incinerating furnace, the value is 4 t/per hour or over; 0.1 ng-TEQ/$m^3$N, 2~4 t/per hour; 1 ng-TEQ/$m^3$N, 2 t/per hour or below; 5 ng-TEQ/$m^3$N. Therefore, the obtained and measured value is confirmed to restrain dioxin generation in a good condition.

What is claimed is:

1. An injection flame burner comprising:

an outer tube and an inner tube provided coaxially with the outer tube;

a plurality of double structure injection nozzles, each composed of the outer tube and the inner tube arranged such that hydrogen gas is ejected either from the inner tubes or from the outer tubes while oxygen gas is ejected from the other tubes; and an injection port of each of the plurality of injection nozzles located in an injection surface; wherein the plurality of injection nozzles is composed of at least one main injection nozzle that is equipped with the inner tube formed to spread toward the injection surface side in a flared shape and sub-injection nozzles, gas that is ejected from the inner tube of said at least one main injection nozzle is ejected at a pressure higher than that ejected from the sub-injection nozzles, the injection port of said at least one main injection nozzle is located at the center with respect to the injection ports of the sub-injection nozzles, and the injection ports of the sub-injection nozzles are arranged at a distance from one another around the injection port of said at least one main injection nozzle so that a flame obtained by burning the gas ejected from said at least one main injection nozzle will collide with a flame obtained by burning the gas ejected from the sub-injection nozzles.

2. A furnace comprising:

the injection flame burner of claim 1; and a burning room, the inside of which is covered with a fireproof material that is durable against a flame temperature that is generated by both the hydrogen gas and the oxygen gas injected from the injection nozzles of the injection flame burner.

3. A method of generating a flame, the method comprising:

providing a plurality of double structure injection nozzles each composed of an outer tube and an inner tube arranged coaxially with the outer tube such that hydrogen gas is ejected either from the inner tubes or from the outer tubes while oxygen gas is ejected the other tubes;

providing an injection port of each of the plurality of injection nozzles located in an injection surface, the plurality of injection nozzles being composed of at least one main injection nozzle that is equipped with the inner tube formed to spread toward the injection surface side in a flared shape and sub-injection nozzles, the injection port of said at least one main injection nozzle being located at the center with respect to the injection ports of the sub-injection nozzles, the injection ports of the sub-injection nozzles being arranged at a distance from one another around the injection port of said at least one main injection nozzle so that a flame obtained by burning the gas ejected from said at least one main injection nozzle will collide with a flame obtained by burning the gas ejected from the sub-injection nozzles, ejecting gas from said at least one main injection nozzle and the sub-injection nozzles, an ejection speed of the gas ejected from the inner tube of said at least one nozzle being higher than that of the gas ejected from the sub-injection nozzles, and obtaining the flame by burning the gas ejected from the main injection nozzle that collides with a flame obtained by burning the gas ejected from the sub-injection nozzle, thereby widening the shape of the collided flame to a flared condition.

* * * * *